US006932009B1

(12) United States Patent
Chen

(10) Patent No.: US 6,932,009 B1
(45) Date of Patent: Aug. 23, 2005

(54) THREAD TENSION ADJUSTMENT DEVICE OF MULTI-NEEDLE SEWING MACHINE

(75) Inventor: Shih-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/849,914

(22) Filed: May 21, 2004

(51) Int. Cl.[7] ..... D05B 47/02
(52) U.S. Cl. ..... 112/254
(58) Field of Search ..... 112/254, 255, 302, 112/163, 452, 165, 166, 197, 258; 242/147 R, 242/149, 150 R, 153

(56) References Cited

U.S. PATENT DOCUMENTS 2,725,840 A * 12/1955 Zeier ..... 112/254
2,925,058 A * 2/1960 Conrad ..... 112/254
2,976,831 A * 3/1961 Hacklander ..... 112/220
3,213,815 A * 10/1965 Russmann ..... 112/302
5,816,175 A * 10/1998 Teramoto ..... 112/165
6,101,961 A * 8/2000 Sakuma ..... 112/255

* cited by examiner

*Primary Examiner*—Ismael Izaguirre
(74) *Attorney, Agent, or Firm*—Rosenberg, Klein & Lee

(57) ABSTRACT

A thread tension adjustment device of multi-needle sewing machine including: a fixing rack fixed on a housing of the sewing machine; multiple frame bodies side by side fixed on the fixing rack; multiple thread tension adjustment units mounted on the frame bodies, each thread tension adjustment unit serving to resiliently clamp a thread, multiple thread-loosening slide boards being respectively slidably disposed on the frame bodies, each thread-loosening slide board having multiple wedge sections; and a link pivotally connected with the thread-loosening slide boards for driving the thread-loosening slide boards to move the wedge sections thereof toward the corresponding thread tension adjustment units to release the threads clamped by the thread tension adjustment buttons of the thread tension adjustment units.

11 Claims, 11 Drawing Sheets

THREAD TENSION ADJUSTMENT DEVICE OF MULTI-NEEDLE SEWING MACHINE

BACKGROUND OF THE INVENTION

1. Field of the Invention

The present invention is related to a thread tension adjustment device of multi-needle sewing machine, and more particularly to a thread tension adjustment device mounted on one side of the sewing machine. Multiple thread-loosening slide boards are driven by a link to control multiple thread tension adjustment buttons for adjusting the tension of the threads.

2. Description of the Prior Art

FIG. 12 shows a conventional multi-needle sewing machine used in industrial sewing. A thread rack 51 is arranged at a remote end of the sewing machine 52. Multiple reels of threads are fitted on the thread rack 51 and guided to the stitching needles of the sewing machine 52. In order to smoothen the stitching of the thread, multiple thread tension adjustment devices 53 are mounted near the thread rack 51 for respectively correspondingly pressing and clamping the threads. Accordingly, the tension of the threads passing through the needles can be tensioned or loosened.

When it is desired to loosen the thread, via a tread switch (not shown), a link (not shown) on the back of the housing of the sewing machine is driven to pull a steel cord 54 and thus pull all the thread tension adjustment devices 53 away. Under such circumstance, the threads are loosened. The thread tension adjustment devices 53 are mounted near the thread rack 5 arranged at the remote end of the sewing machine 52. Therefore, some shortcomings exist in the sewing machine as follows:

1. The thread tension adjustment devices 53 are arranged at the remote end of the sewing machine 52. In sewing operation, when an operator desires to adjust the tension of some of the threads, the operator needs to extend his/her hand to the remote end for adjustment. This is quite inconvenient.

2. The thread tension adjustment devices 53 is spaced from the sewing machine 52 by a considerable distance so that it is hard for the thread tension adjustment devices 53 to truly tension the threads between the thread tension adjustment devices 53 and the sewing machine 52. As a result, the tension of the threads can be hardly accurately adjusted and the threads tend to be torn down. This leads to inconvenience in sewing operation.

SUMMARY OF THE INVENTION

It is therefore a primary object of the present invention to provide a thread tension adjustment device of multi-needle sewing machine, which is mounted on one side of the sewing machine. An operator can handily loosen the threads or adjust the tension of the threads. Therefore, the thread tension adjustment operation is facilitated and speeded.

It is a further object of the present invention to provide the above thread tension adjustment device of multi-needle sewing machine, in which multiple thread tension adjustment buttons can be operated at the same time to loosen multiple threads. Therefore, the thread-loosening operation can be more truly and quickly completed.

According the above objects, the thread tension adjustment device of multi-needle sewing machine includes: a fixing rack fixed on a housing of the sewing machine; multiple thread tension adjustment units mounted on the fixing rack, each thread tension adjustment unit including a frame body fixed on the fixing rack, multiple thread tension adjustment buttons being arranged on the frame body, each thread tension adjustment button serving to resiliently clamp a thread, a thread-loosening slide board being slidably disposed on each frame body, the thread-loosening slide board having multiple wedge sections each of which is aligned with a gap between a first and a second clamping trays of the thread tension adjustment button; and a link pivotally connected with the thread-loosening slide boards for driving the thread-loosening slide boards to move the wedge sections thereof toward the corresponding thread tension adjustment buttons and insert the wedge sections into the gaps between first and second clamping trays of the thread tension adjustment buttons. After the wedge sections of the thread-loosening slide boards are inserted into the gaps between the first and second clamping trays of the thread tension adjustment buttons, the gaps are enlarged to release the threads clamped by the thread tension adjustment buttons.

The present invention can be best understood through the following description and accompanying drawings wherein:

DETAILED DESCRIPTION OF THE PREFERRED EMBODIMENTS

Figure 1:
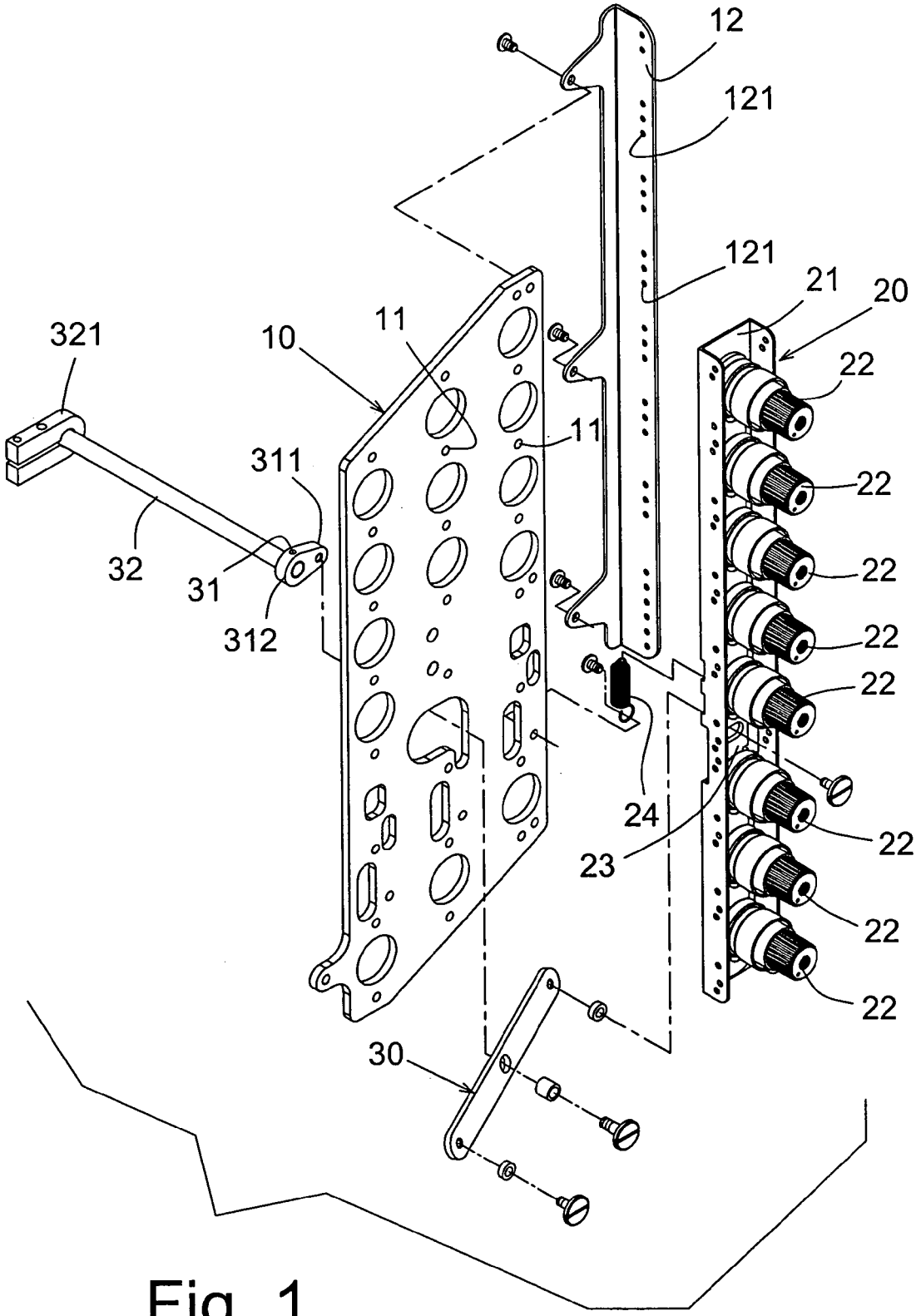
FIG. 1 is a perspective partially exploded view of the present invention.

Please refer to FIGS. 1 to 11. The thread tension adjustment device of multi-needle sewing machine of the present invention includes: a fixing rack 10 fixed on a housing 100 of the sewing machine; multiple thread tension adjustment units 20 mounted on the fixing rack 10, each thread tension adjustment unit 20 including a frame body 21 fixed on the fixing rack 10, multiple thread tension adjustment buttons 22 being arranged on the frame body 21 for respectively resiliently clamping a thread, a thread-loosening slide board 23 being slidably disposed on each frame body 21, the slide board 23 having multiple wedge sections 232 aligned with a gap between a first and a second clamping trays 222, 223 of the thread tension adjustment button 22; and a link 30 pivotally connected with the thread-loosening slide boards 23 for driving the thread-loosening slide boards 23 to insert the wedge sections 232 thereof into the gap between first and second clamping trays 222, 223 of the thread tension adjustment button 22. After the wedge sections 232 of the thread-loosening slide boards 23 are inserted into the gap between the first and second clamping trays 222, 223 of the thread tension adjustment button 22, the gap is enlarged to release the thread clamped by the thread tension adjustment button 22.

Referring to FIG. 1, the fixing rack 10 is formed with multiple fixing threaded holes 11. The threaded rods 221 of the thread tension adjustment buttons 22 are screwed in the threaded holes 11 to tightly fix the frame body 21 of the thread tension adjustment unit 20 on the fixing rack 10.

A thread-guiding board 12 is locked on one side of the fixing rack 10. The thread-guiding board 12 is formed with multiple guide eyelets 121. The threads L coming from an external remote thread rack 40 are passed through the eyelets 121 and guided to a thread tension adjustment button 22 which resiliently clamps the thread.

Figure 2:
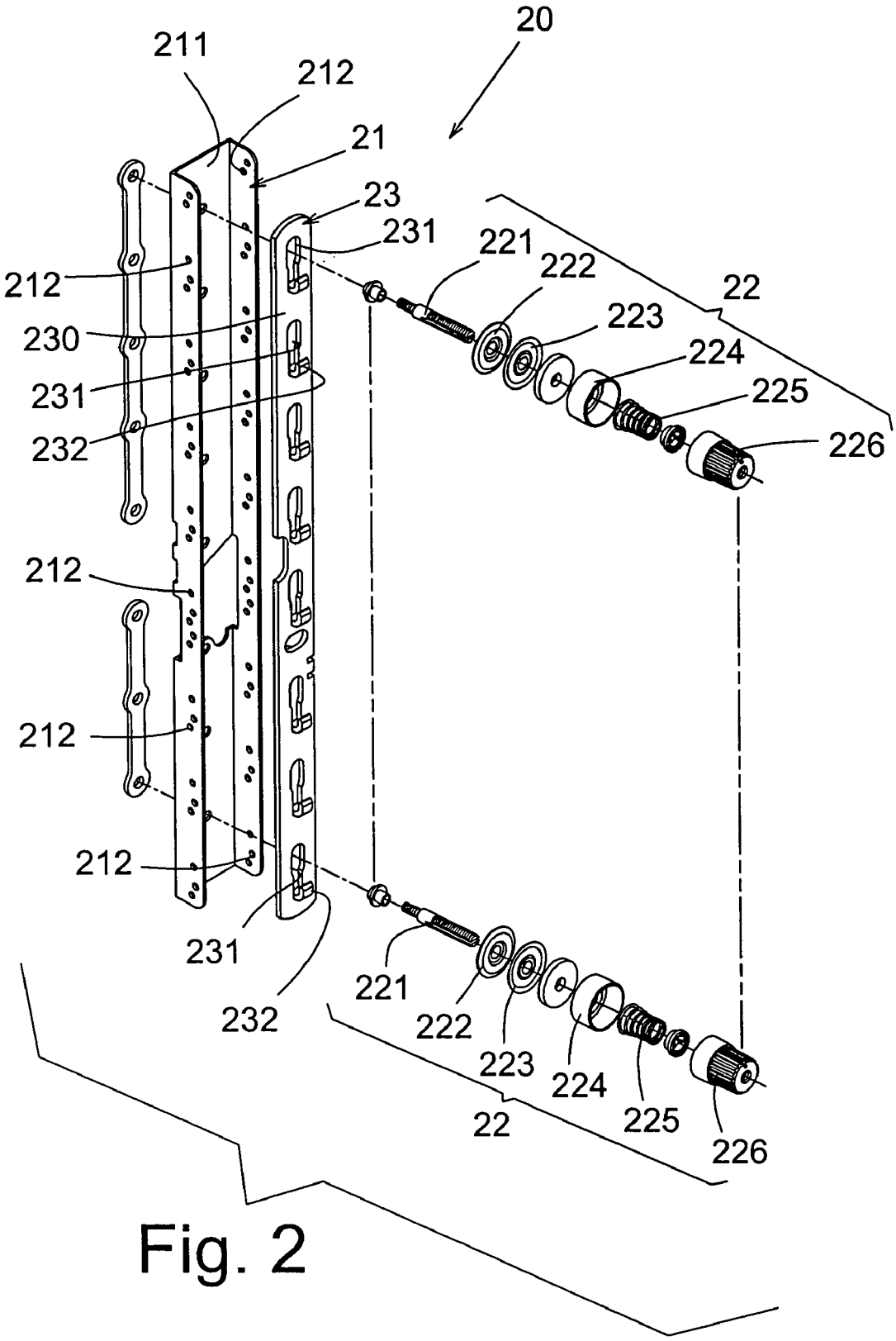
FIG. 2 is a perspective exploded view of the thread tension adjustment unit of the present invention.
Figure 3:
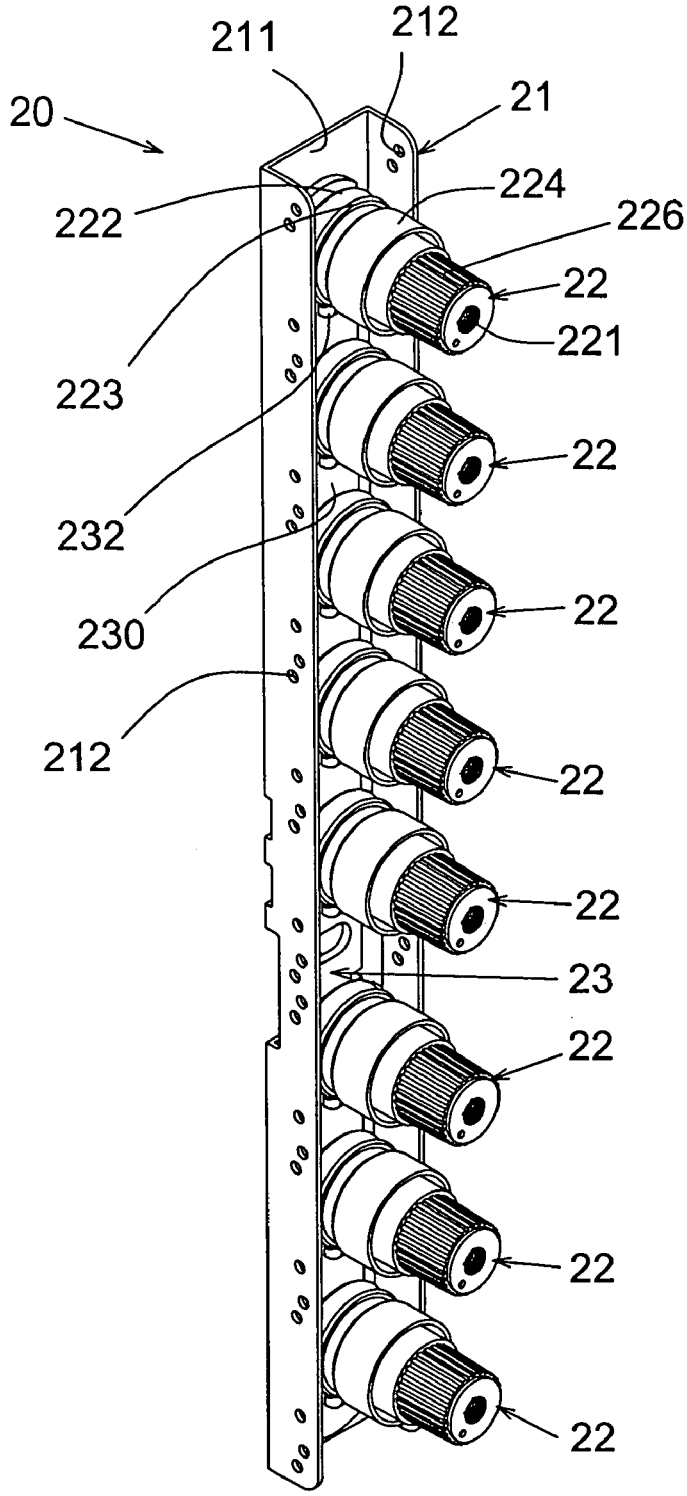
FIG. 3 is a perspective assembled view of the thread tension adjustment unit of the present invention.
Figure 4:
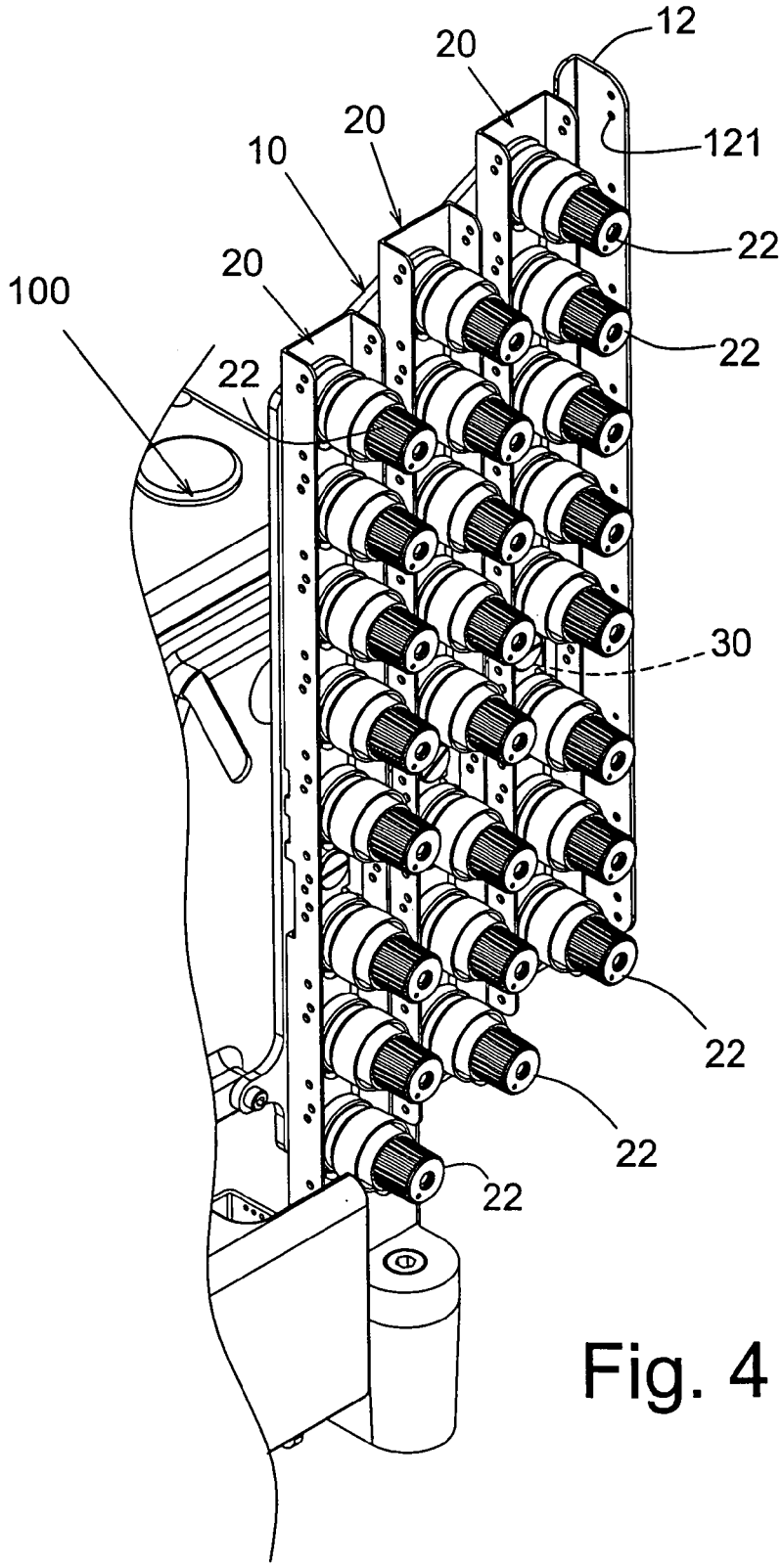
FIG. 4 is a perspective view showing that the present invention is mounted on the housing of the sewing machine.
Figure 11:
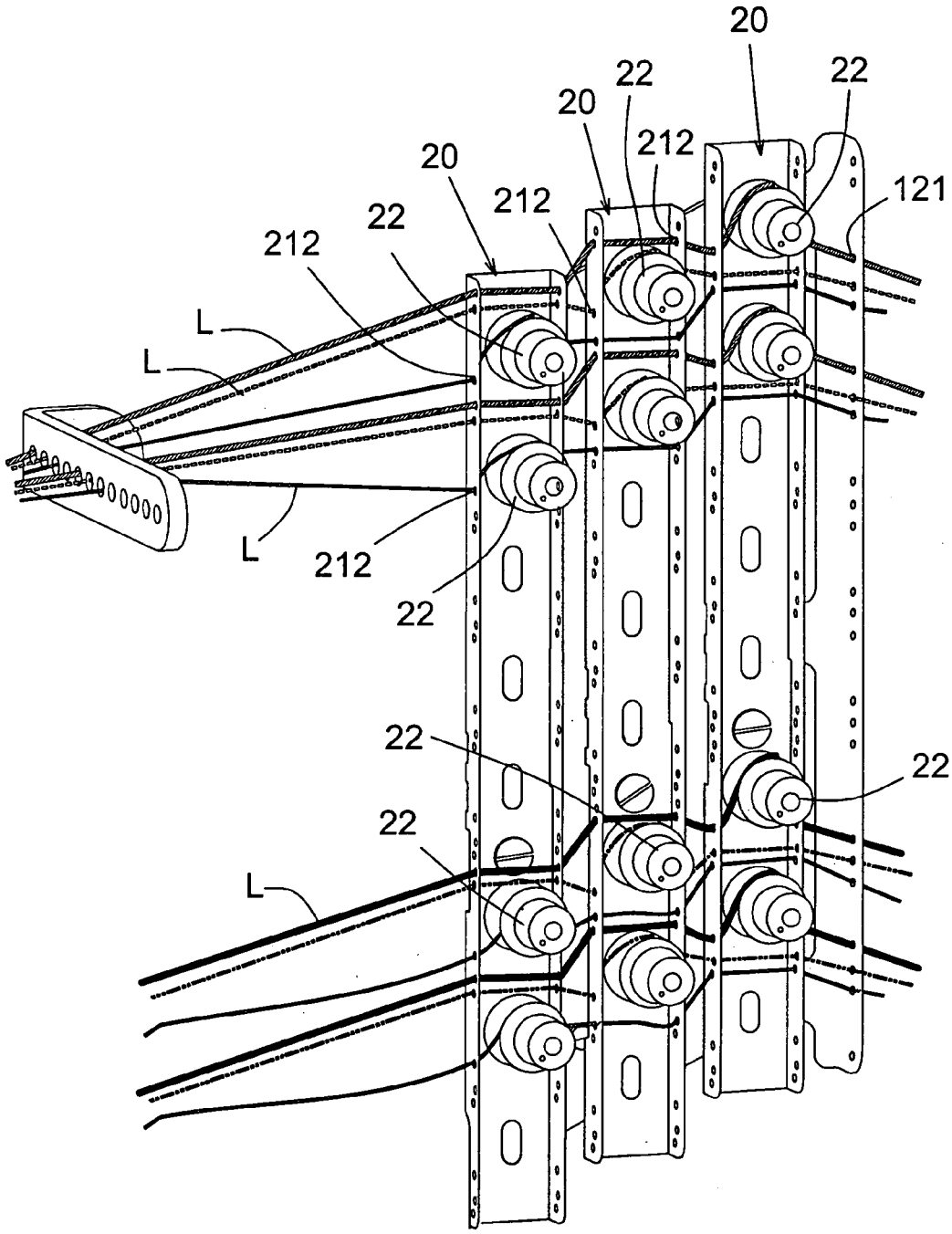
FIG. 11 shows the threading state of the present invention.
Figure 12:
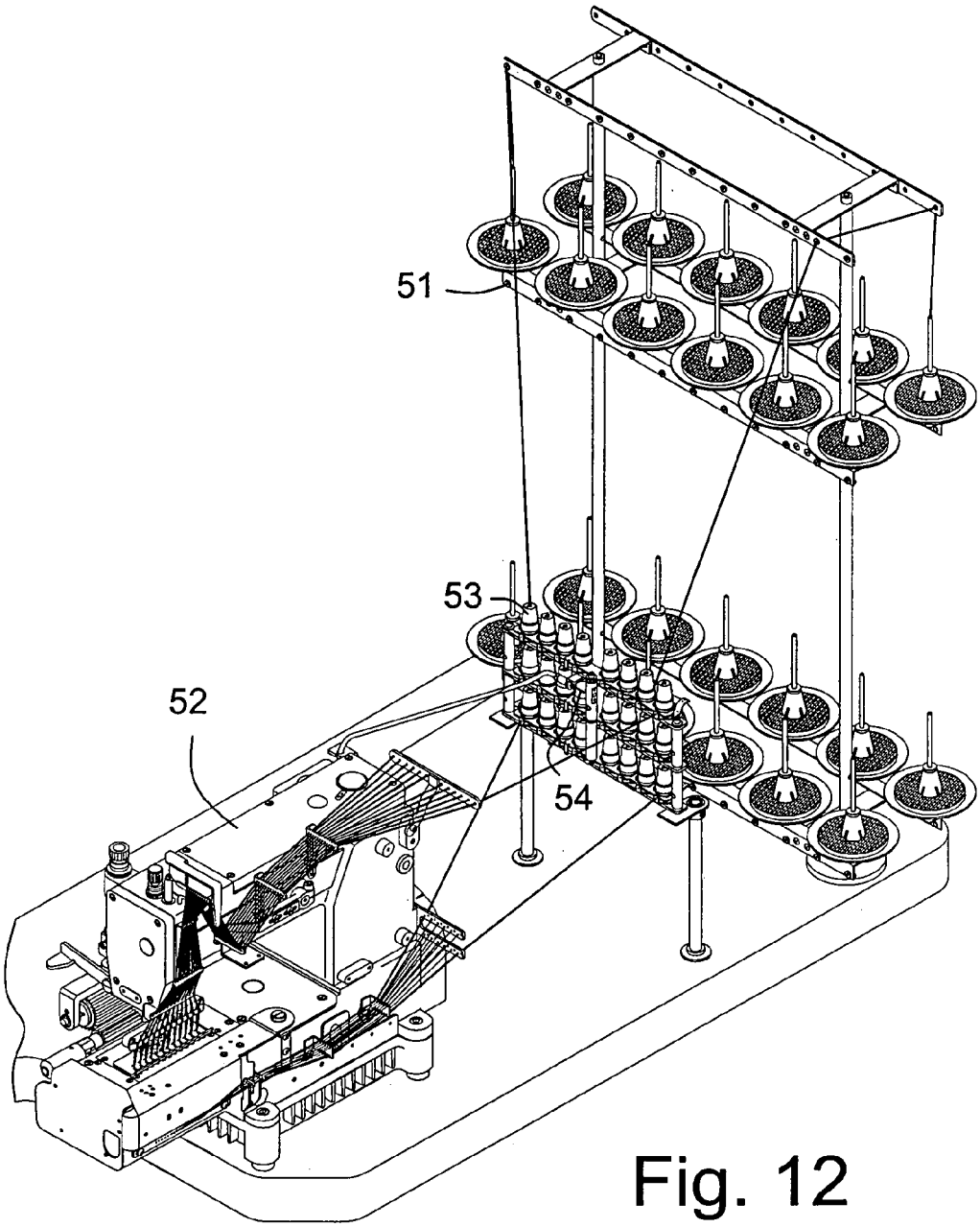
Fig. 12 PRIOR ART
FIG. 12 shows the application of a conventional sewing machine.

Referring to FIGS. 1, 2 and 3, the thread tension adjustment unit 20 includes a frame body 21 having a substrate section 211 tightly fixed on the fixing rack 10. Two sidewalls respectively project from two sides of the substrate 211. Each sidewall is formed with multiple guide eyelets 212 through each of which a thread L is passed and guided (as shown in FIG. 11). The thread tension adjustment unit 20 further includes multiple thread tension adjustment buttons 22 each having a threaded rod 221. A first end of the threaded rod 221 is passed through the frame body 21 and screwed in the fixing rack 10. A first clamping tray 22, a second clamping tray 223, a push sleeve 224 and a restoring spring 225 are sequentially fitted on a second end of the threaded rod 221. An adjustment nut 226 is screwed on the rearmost end of the second end of the threaded rod 221 for forcing the restoring spring 225 to always push the second clamping tray 223 tightly against the first clamping tray 222. Accordingly, a thread-clamping space is defined between the first and second clamping trays 222, 223 for resiliently clamping a thread which passes therethrough. The thread tension adjustment unit 20 further includes a thread-loosening slide board 23 having a board body 230 formed with multiple slide slots 231. The threaded rods 221 of the thread tension adjustment buttons 22 are respectively correspondingly fitted in the slide slots 231, whereby the thread-loosening slide board 23 can be guided by the threaded rods 221 to linearly slide. In addition, the board body 230 of the thread-loosening slide board 23 has multiple projecting wedge sections 232 respectively aligned with the gaps between the first and second clamping trays 222, 223 of the thread tension adjustment buttons 22. The wedge sections 232 of the thread-loosening slide boards 23 can be operably inserted into the gaps between the first and second clamping trays 222, 223 to enlarge the gaps so as to release the threads clamped between the first and second clamping trays 222, 223.

A first end of a shift cam 31 is pivotally connected with the center of the link 30. A second end 312 of the shift cam 31 is fitted on a first end of a rotary shaft. When turning the rotary shaft 32, the first end 311 of the shift cam 31 is driven to push the thread-loosening slide board 23 of the thread tension adjustment unit 20.

Referring to FIG. 1, a second end of the rotary shaft 32 is connected with a rocking bar 321. A free end of the rocking bar 321 is connected with a pedal (not shown). Accordingly, by means of treading the pedal, the rotary shaft 32 can be rotated to shift the thread-loosening slide board 23.

The rotary shaft 32 is pivotally mounted in the housing 100 of the sewing machine. The rocking bar 321 connected with the second end of the rotary shaft 32 is a rotary button, whereby an operator can directly turn the rocking bar 321 to drive the link 30.

Figure 5:
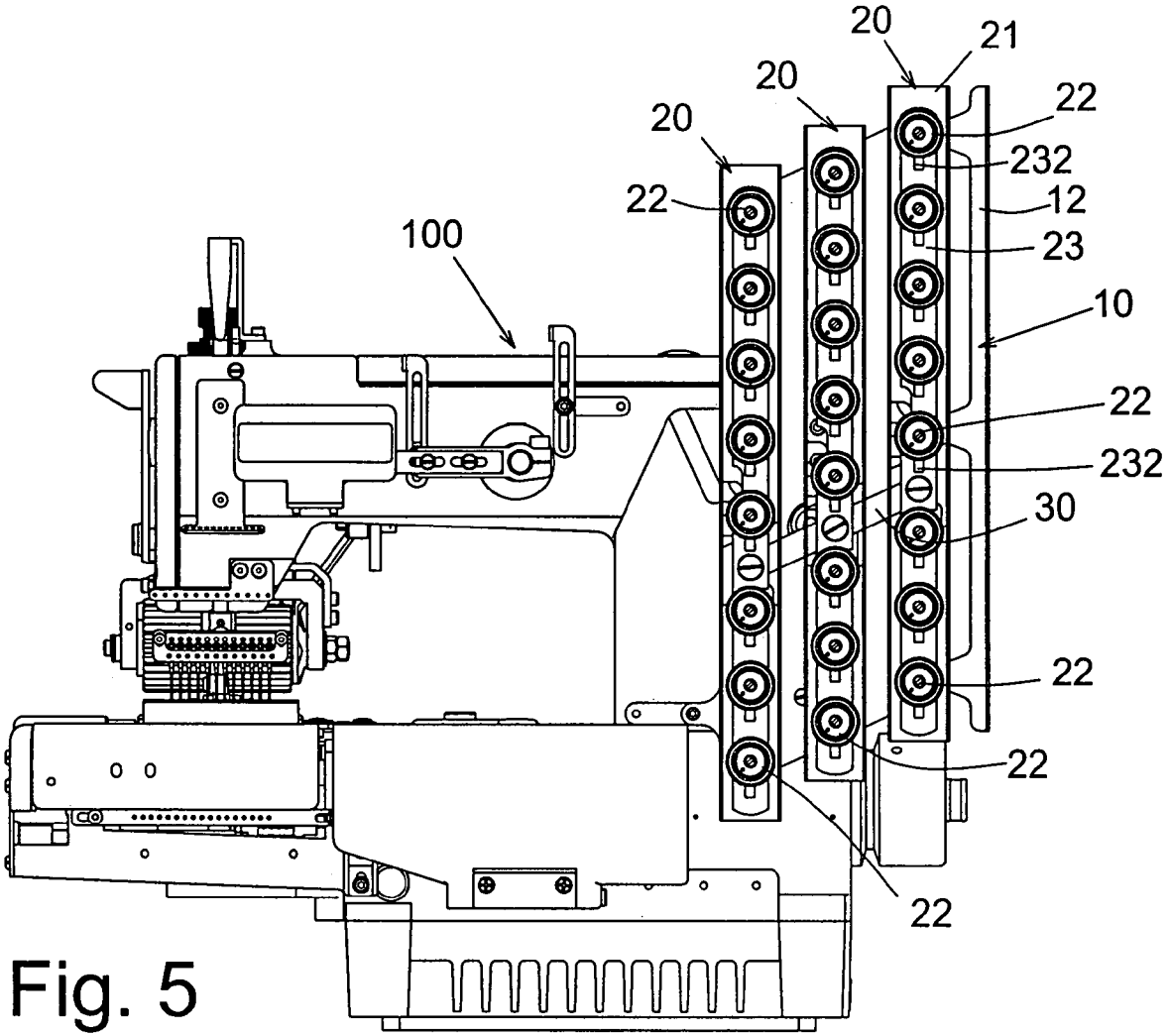
FIG. 5 is a plane view showing that the present invention is mounted on a housing of the sewing machine.
Figure 6:
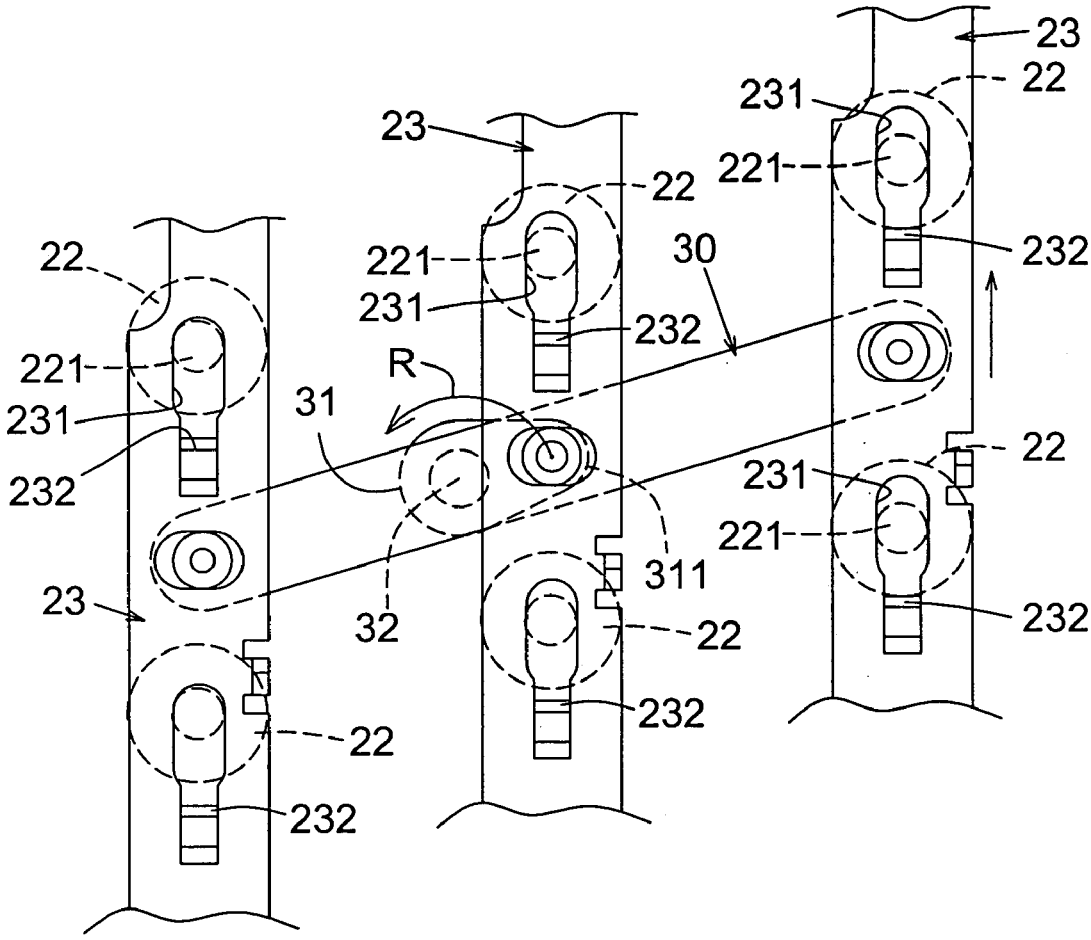
FIG. 6 shows that the link of the present invention pushes the thread-loosening slide boards, in which the wedge section of the thread-loosening slide board on right side of the link first touches the thread tension adjustment button.
Figure 7:
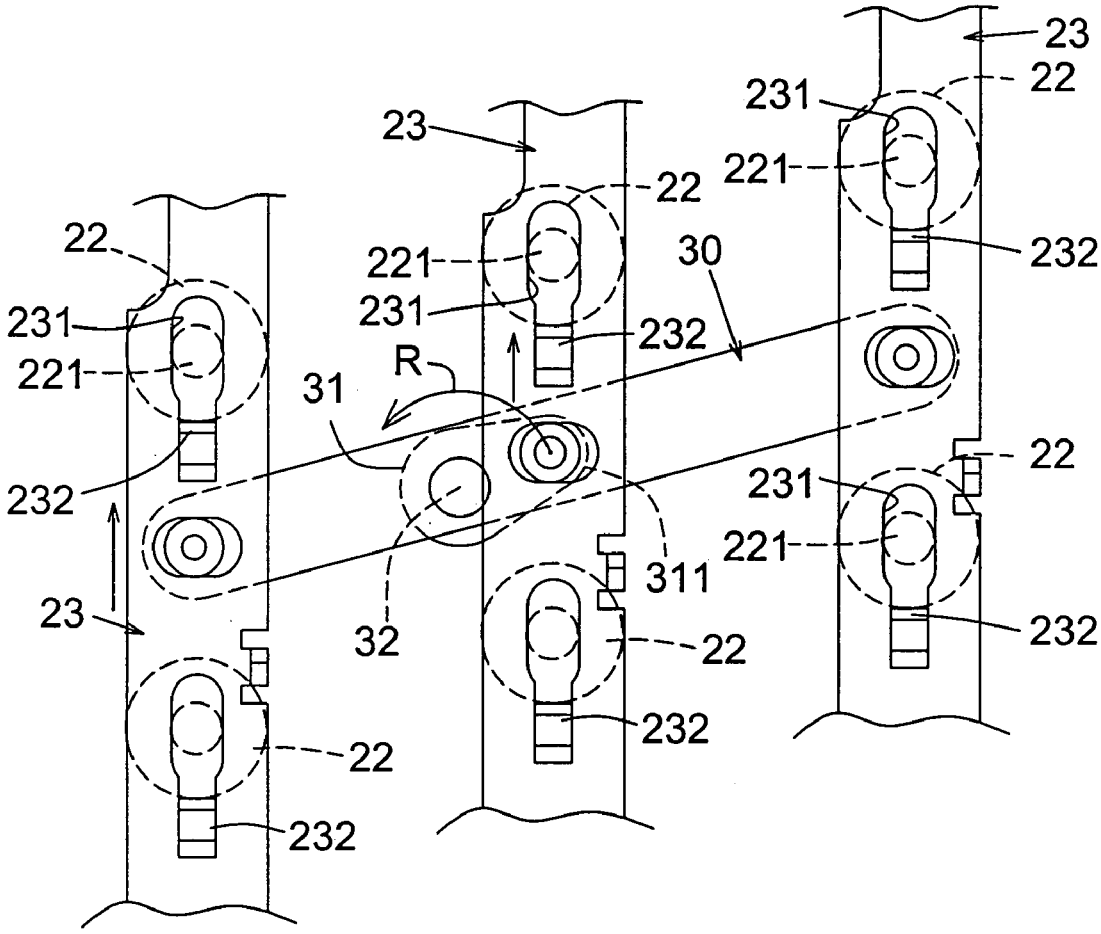
FIG. 7 is a view according to FIG. 6, showing that the thread-loosening slide boards are further pushed and lifted to make the wedge sections of all the thread-loosening slide boards touch the thread tension adjustment buttons.
Figure 8:
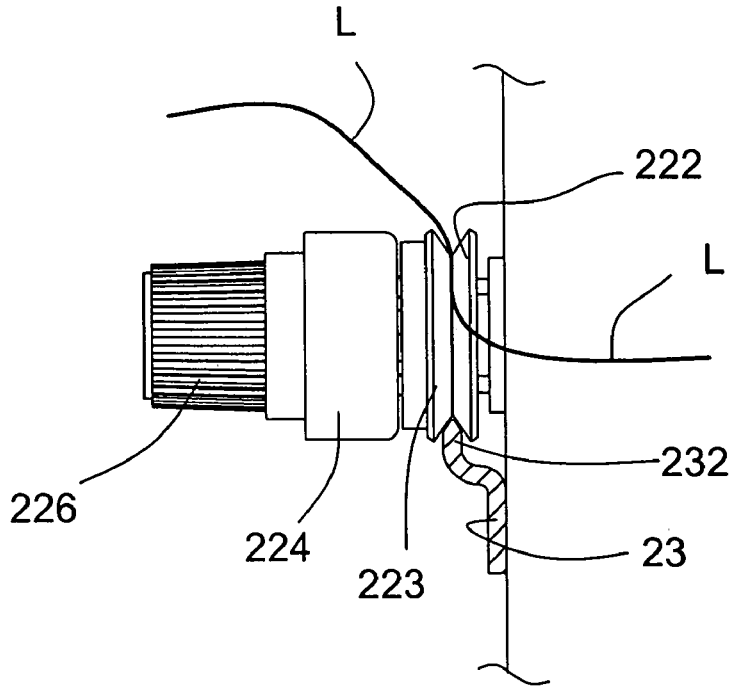
FIG. 8 shows that the wedge section of the thread-loosening slide board has not yet inserted between the first and second clamping trays.
Figure 9:
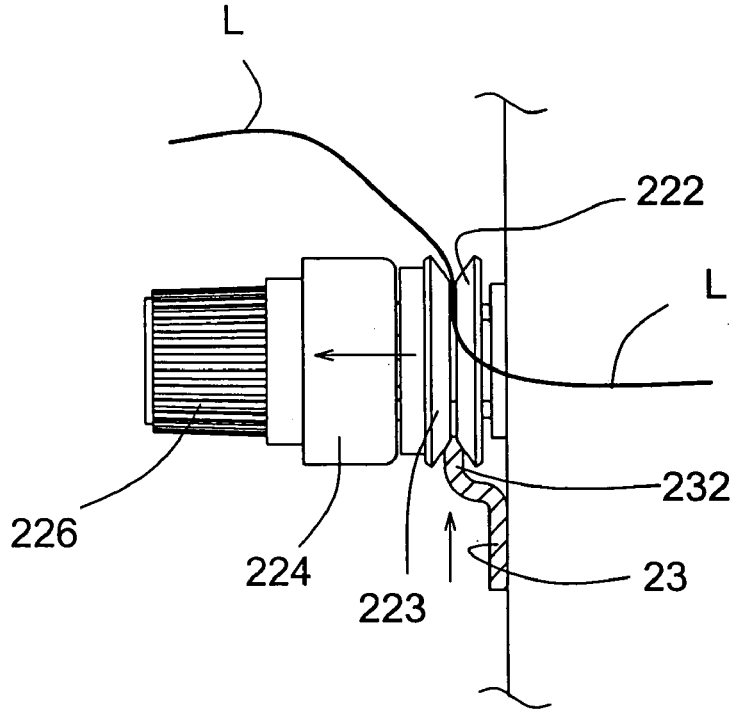
FIG. 9 shows that the wedge section of the thread-loosening slide board is inserted between the first and second clamping trays.
Figure 10:
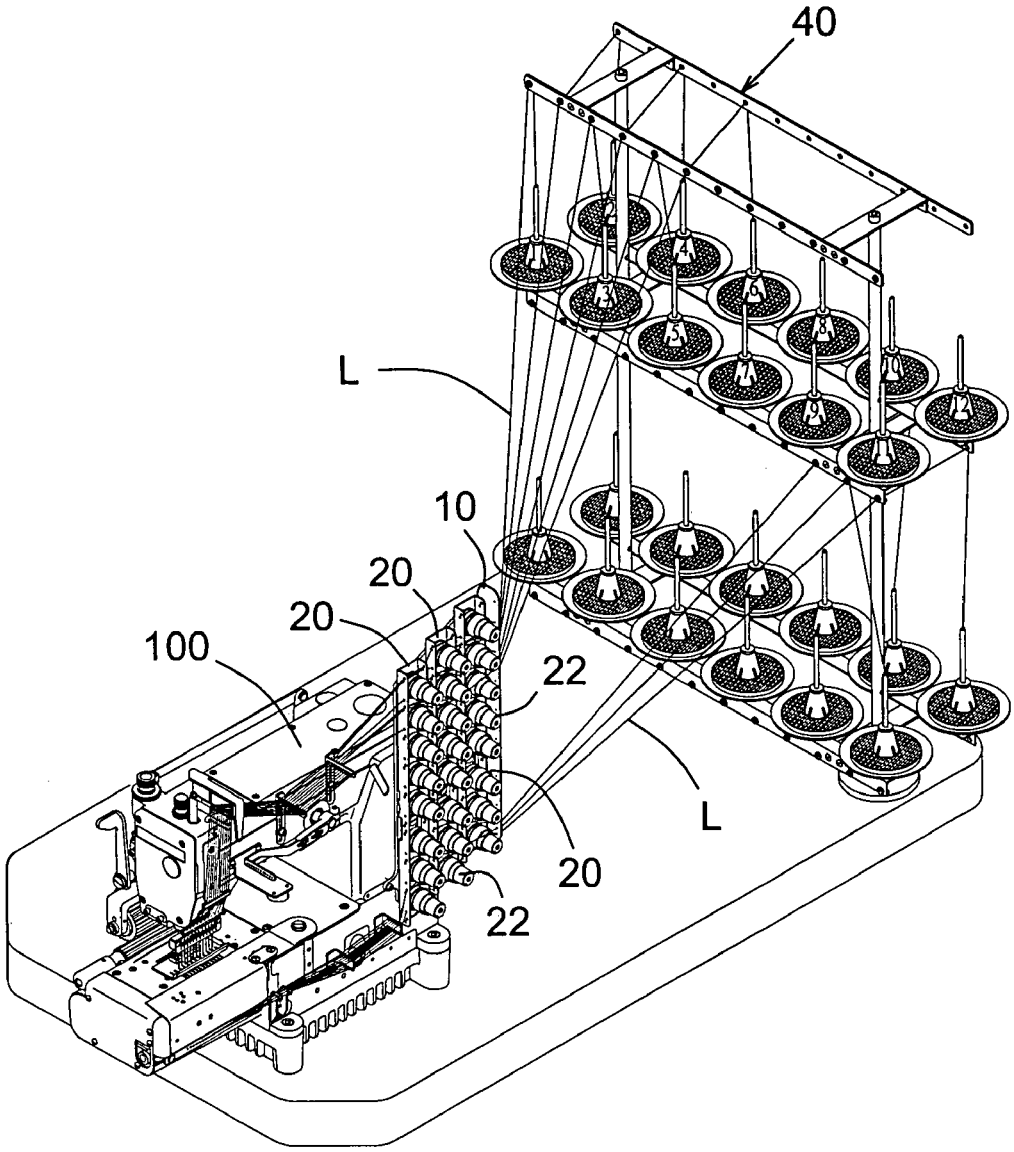
FIG. 10 shows the application of the present invention.

Referring to FIGS. 1, 5 and 6, the center of the link 30 is pivotally connected with the first end 311 of the shift cam 31. The thread-loosening slide boards 23 are pivotally connected on the link 30 at equal intervals. Accordingly, when the link 30 is drivingly lifted by the shift cam 31 as shown in FIG. 5 and the wedge section 232 of the thread-loosening slide board 23 on right side of the link 30 first touches the corresponding thread tension adjustment button 22, the resistance is increased so that the link 30 will be pivoted in a clockwise direction R about the pivot via which the link 30 is pivotally connected with the shift cam 31 as shown in FIG. 6. At this time, the thread-loosening slide boards 23 pivotally connected with left section and the center of the link 30 are ascended. The wedge sections 232 of these thread-loosening slide boards 23 will automatically move toward the corresponding thread tension adjustment buttons 22 until the wedge sections 232 contact with the thread tension adjustment buttons 22. Then the wedge sections 232 are stopped as shown in FIGS. 7 and 8. When the operator further pushes the link 30, the wedge sections 232 of these thread-loosening slide boards 23 will be inserted into the gaps between the first and second clamping trays 222, 223 of the thread tension adjustment buttons 22 as shown in FIG. 9 to enlarge the gap in which the thread is clamped. At this time, the thread clamped by the thread tension adjustment button 22 is released.

In the thread tension adjustment device of multi-needle sewing machine of the present invention, a spring 24 is always hooked between the thread-loosening slide board 23 and a fixed article (such as the fixing rack 10). The spring 24 always makes the wedge sections 232 away from the corresponding thread tension adjustment button 22, that is, makes the wedge sections 232 tend to totally extracted out of the gap between the first and second clamping trays 222, 223 of the thread tension adjustment button 22. Accordingly, after an operator adjusts the tension of the thread, the wedge sections 232 are automatically restored to their home positions and the thread tension adjustment button 22 again clamps the thread.

The thread tension adjustment device of multi-needle sewing machine of the present invention is mounted on one side of the housing of the sewing machine. The reels of threads L positioned on a remote thread rack 40 are respectively guided to the thread tension adjustment units 20 and clamped by the same as shown in FIGS. 8 to 11. An operator can clearly know the present state of the threads of the sewing machine. In the case that a thread L is too loosened or too tensioned, the operator can handily adjust the pressure exerted onto the thread L by the first and second clamping trays 222, 223 of the corresponding thread tension adjustment button 22. Therefore, the adjustment operation is facilitated and speeded.

The above embodiments are only used to illustrate the present invention, not intended to limit the scope thereof. Many modifications of the above embodiments can be made without departing from the spirit of the present invention.

What is claimed is:

1. A thread tension adjustment device of multi-needle sewing machine comprising:

(a) a fixing rack fixed on a housing of the sewing machine;

(b) multiple thread tension adjustment units mounted on the fixing rack, each thread tension adjustment unit including a frame body fixed on the fixing rack, multiple thread tension adjustment buttons being arranged on the frame body, each thread tension adjustment button serving to resiliently clamp a thread, a thread-loosening slide board being slidably disposed on each frame body, the thread-loosening slide board having multiple wedge sections each of which is aligned with a gap between a first and a second clamping trays of the thread tension adjustment button; and (c) a link pivotally connected with the thread-loosening slide boards for driving the thread-loosening slide boards to move the wedge sections thereof toward the corresponding thread tension adjustment buttons and insert the wedge sections into the gaps between first and second clamping trays of the thread tension adjustment buttons, whereby after the wedge sections of the thread-loosening slide boards are inserted into the gaps between the first and second clamping trays of the thread tension adjustment buttons, the gaps are enlarged to release the threads clamped by the thread tension adjustment buttons.

2. The thread tension adjustment device of multi-needle sewing machine as claimed in claim 1, wherein the fixing rack is formed with multiple fixing threaded holes and each thread tension adjustment button has a threaded rod, whereby the threaded rods are screwed in the threaded holes of the fixing rack to tightly fix the frame body of the thread tension adjustment unit on the fixing rack.

3. The thread tension adjustment device of multi-needle sewing machine as claimed in claim 1, wherein a thread-guiding board is locked on one side of the fixing rack, the thread-guiding board being formed with multiple guide eyelets, whereby the threads coming from an external thread rack are passed through the eyelets and guided to a thread tension adjustment button.

4. The thread tension adjustment device of multi-needle sewing machine as claimed in claim 1, wherein the frame body of the thread tension adjustment unit has a substrate section tightly fixed on the fixing rack, two sidewalls respectively projecting from two sides of the substrate, each sidewall being formed with multiple guide eyelets through each of which a thread is passed.

5. The thread tension adjustment device of multi-needle sewing machine as claimed in claim 1, wherein the thread tension adjustment button of the thread tension adjustment unit has a threaded rod, a first end of the threaded rod being passed through the frame body and screwed in the fixing rack, a first clamping tray, a second clamping tray, a push sleeve and a restoring spring being sequentially fitted on a second end of the threaded rod, an adjustment nut being screwed on a rearmost end of the second end of the threaded rod.

6. The thread tension adjustment device of multi-needle sewing machine as claimed in claim 1, wherein the thread-loosening slide board of the thread tension adjustment unit has a board body formed with multiple slide slots, the threaded rods of the thread tension adjustment buttons being respectively correspondingly fitted in the slide slots, the board body of the thread-loosening slide board having multiple projecting wedge sections respectively aligned with the gaps between the first and second clamping trays of the thread tension adjustment buttons.

7. The thread tension adjustment device of multi-needle sewing machine as claimed in claim 1, wherein a first end of a shift cam is pivotally connected with a center of the link, a second end of the shift cam being fitted on a first end of a rotary shaft, whereby when turning the rotary shaft, the first end of the shift cam is driven to push the thread-loosening slide boards of the thread tension adjustment units.

8. The thread tension adjustment device of multi-needle sewing machine as claimed in claim 7, wherein a second end of the rotary shaft is connected with a rocking bar, a free end of the rocking bar being connected with a pedal.

9. The thread tension adjustment device of multi-needle sewing machine as claimed in claim 7, wherein the rotary shaft is pivotally mounted in the housing of the sewing machine, the rocking bar connected with the second end of the rotary shaft being a rotary button, whereby an operator can directly turn the rocking bar to drive the rotary shaft.

10. The thread tension adjustment device of multi-needle sewing machine as claimed in claim 1, wherein a center of the link is pivotally connected with the first end of a shift cam, the thread-loosening slide boards being pivotally connected on the link at equal intervals.

11. The thread tension adjustment device of multi-needle sewing machine as claimed in claim 1, wherein a spring is always hooked between the thread-loosening slide board and a fixed article, whereby the spring always makes the wedge sections away from the corresponding thread tension adjustment button and makes the wedge sections tend to totally extracted out of the gaps between the first and second clamping trays of the thread tension adjustment buttons.

* * * * *